US008159158B2

(12) United States Patent
Popovic et al.

(10) Patent No.: US 8,159,158 B2
(45) Date of Patent: Apr. 17, 2012

(54) RF CAVITY USING LIQUID DIELECTRIC FOR TUNING AND COOLING

(75) Inventors: Milorad Popovic, Warrenville, IL (US); Rolland P. Johnson, Newport News, VA (US)

(73) Assignee: Muons, Inc., Batavia, IL (US)

( * ) Notice: Subject to any disclaimer, the term of this patent is extended or adjusted under 35 U.S.C. 154(b) by 690 days.

(21) Appl. No.: 12/359,810

(22) Filed: Jan. 26, 2009

(65) Prior Publication Data

US 2012/0062153 A1 Mar. 15, 2012

(51) Int. Cl.
*H05H 11/00* (2006.01)
*F25B 17/00* (2006.01)

(52) U.S. Cl. ..... 315/500; 62/51.1

(58) Field of Classification Search ..... 313/62, 313/359.1, 362.1; 315/500, 501; 62/51.1
See application file for complete search history.

(56) References Cited

U.S. PATENT DOCUMENTS

| | | | | |
|---|---|---|---|---|
| 3,340,483 | A | 9/1967 | Clark | |
| 3,449,618 | A * | 6/1969 | Gallagher | 315/5.41 |
| 4,010,396 | A * | 3/1977 | Ress et al. | 313/231.31 |
| 4,048,437 | A * | 9/1977 | Vander Arend et al. | 174/15.5 |
| 5,849,252 | A * | 12/1998 | Wakamoto et al. | 422/186.04 |
| 6,172,463 | B1 * | 1/2001 | Cutler et al. | 315/5.42 |
| 6,593,539 | B1 * | 7/2003 | Miley et al. | 219/121.36 |
| 6,688,116 | B1 * | 2/2004 | Schneider et al. | 62/55.5 |
| 6,921,042 | B1 | 7/2005 | Goodzeit et al. | |

OTHER PUBLICATIONS

Kashikhin, V. S, et al., "Superconducting Magnet System for Muon Beam Cooling", *IEEE Transactions on Applied Superconductivity* vol. 17, No. 2, (Jun. 2007), 1055-1058.
Kaspar, Klaus, et al., "Studies on Maximum RF Voltages in Ferrite-tuned Accelerating Cavities", *FAIR-ACC-04*, [Online]. Retrieved from the Internet: <URL: http://www.gsi.de/informationen/wti/library/scientificreport2004/PAPERS/FAIR-ACC-04.pdf>, 1 pg.
Meinke, R. B, et al., "Superconducting Double-Helix Accelerator Magnets", *Proceedings for the 2003 Particle Accelerator Conference*, (2003), 1996-1998.
Meyer, D. I, et al., "A New Configuration for a Dipole Magnet for Use in High Energy Physics Applications", *Nuclear Instruments and Methods* vol. 80, (1970), 339-341.
Poirier, R L, et al., "Parallel Bias vs Perpendicular Bias of a Ferrite Tune Cavity for the Triumf Kaon Factory Booster Ring", *Proceedings of 1st European Particle Accelerator Conference*, [Online]. Retrieved from the Internet:<URL: http:accelconf.web.cern.ch/accelconf/e88/PDF/EPAC1988_1321.PDF>, (1998), 1321-1323.
Popovic, Milorad, et al., "Compact Tunable RF Cavities", *PAC07 Abstract*, [Online]. Retrieved from the Internet: <URL: http://appora.fnal.gov/pls/pac07/JACoW.print_abstract?abs_ID=2164>, (Dec. 13, 2006), 1 pg.
Popovic, Milorad, et al., "Compact, Tunable RF Cavities", *Proceedings of EPAC08*, [Online]. Retrieved from the Internet: <URL: http://accelconf.web.cern.ch/AccelConf/e08/papers/mopp105.pdf>, 802-804.

(Continued)

*Primary Examiner* — Dean O Takaoka
(74) *Attorney, Agent, or Firm* — Schwegman, Lundberg & Woessner, P.A.

(57) ABSTRACT

A system for accelerating particles includes an RF cavity that contains a ferrite core and a liquid dielectric. Characteristics of the ferrite core and the liquid dielectric, among other factors, determine the resonant frequency of the RF cavity. The liquid dielectric is circulated to cool the ferrite core during the operation of the system.

26 Claims, 6 Drawing Sheets

OTHER PUBLICATIONS

Popovic, Milorad, "Phase I-SBIR/STTR Fiscal Year 2007: Compact, Tunable RF Cavities", *Fermi National Accelerator Laboratory*, [Online]. Retrieved from the Internet: <URL: http//accelconf.web.cern.ch/accelconf/e88/PDF/EPAC1988_1321.PDF>, (Jul. 13, 2007), 18 pgs.

Shaffer, G, "New Design Concepts for Ferrite-Tune Low-Energy Booster Cavities", *Superconducting Super Collider Laboratory SSCL-457*, (May 1991), 8 pgs.

Griffin, J., "RF Intensity Limitation in the Main Injector", [Online]. Retrieved from the Internet: <URL: http://beamdocs.fnal.gov/DocDB/0000/000019/002/MI-0018.pdf>, (Aug. 18, 1989), 7 pgs.

* cited by examiner

RF CAVITY USING LIQUID DIELECTRIC FOR TUNING AND COOLING

GOVERNMENT SUPPORT

This invention was made with government support under Grant Number(s) DE-FG02-07ER86320 awarded by the United States Department of Energy. The United States Government has certain rights in the invention.

TECHNICAL FIELD

This document relates generally to particle accelerators and particularly to a radio-frequency (RF) cavity for use in a synchrotron or beam line where the velocity of particles changes.

BACKGROUND

An RF cavity is used in a particle accelerator to accelerate a particle beam using an RF electromagnetic field. Development of fixed-field alternating gradient (FFAG) synchrotron technology has sparked interest in its use in various commercial machines. Upgrades of existing synchrotrons and improvements to other particle accelerator designs are also in need of RF cavities that fit into physically limited spaces of a practical machine and rapidly change frequency over a wide range. Thus, there is a need for RF cavities that are suitable for use in an accelerator whose acceptance depends on its functional capability as well as physical size.

SUMMARY

A system for accelerating particles includes an RF cavity that contains a ferrite core and a liquid dielectric. Characteristics of the ferrite core and the liquid dielectric, among other factors, determine the resonant frequency of the RF cavity. The liquid dielectric is circulated to cool the ferrite core during the operation of the system.

In one embodiment, a system for accelerating a particle beam in a particle accelerator includes a vacuum beam pipe, an RF cavity, and a coolant circulation system. The vacuum beam pipe allows passage of the particle beam. The RF cavity surrounds the beam pipe and includes a wall forming a chamber that contains a liquid dielectric and a ferrite core. The ferrite core surrounds the vacuum beam pipe. A liquid inlet and a liquid outlet on the wall allow the liquid dielectric to be circulated through the chamber to cool the ferrite core. The coolant circulation system is coupled to the RF cavity to circulate the liquid dielectric through the chamber at a circulation speed that is controlled using a temperature of the liquid dielectric.

In one embodiment, a method for accelerating a particle beam in a particle accelerator is provided. The particle beam is passed in a vacuum beam pipe through an RF cavity including a ferrite core surrounding the vacuum beam pipe. A liquid dielectric is circulated through the RF cavity to cool the ferrite core. The circulation speed at which the liquid dielectric is circulated through the RF cavity is adjusted using the sensed temperature of the liquid dielectric.

This Summary is an overview of some of the teachings of the present application and not intended to be an exclusive or exhaustive treatment of the present subject matter. Further details about the present subject matter are found in the detailed description and appended claims. Other aspects of the invention will be apparent to persons skilled in the art upon reading and understanding the following detailed description and viewing the drawings that form a part thereof. The scope of the present invention is defined by the appended claims and their legal equivalents.

BRIEF DESCRIPTION OF THE DRAWINGS

The drawings illustrate generally, by way of example, various embodiments discussed in the present document. The drawings are for illustrative purposes only and may not be to scale.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined, or that other embodiments may be utilized and that structural, logical and electrical changes may be made without departing from the spirit and scope of the present invention. The following detailed description provides examples, and the scope of the present invention is defined by the appended claims and their legal equivalents.

It should be noted that references to "an", "one", or "various" embodiments in this disclosure are not necessarily to the same embodiment, and such references contemplate more than one embodiment.

This document discusses, among other things, a compact, tunable radio-frequency (RF) cavity for use in a synchrotron or beam line where the velocity of particles changes, such as a fixed-field alternating gradient (FFAG) synchrotron. New developments in the design of FFAG synchrotrons have sparked interest in their use as rapid-cycling, high intensity accelerators for particles such as ions, protons, muons, and electrons. Potential FFAG applications include medical accelerators of protons and light ions for cancer therapy, proton drivers for neutron or muon production, rapid muon accelerators, and electron accelerators for synchrotron light sources. In various embodiments, the present RF cavity establishes or enhances feasibility of the FFAG synchrotron for such applications. In various embodiments, the compact size of the RF cavity allows for expansion of capabilities of an existing machine with limited space for additional components.

In one embodiment, the RF cavity includes an orthogonally biased ferrite core that allows for rapid tuning over various frequency ranges. A liquid dielectric is used for adjusting the frequency range and cooling the ferrite core.

One example of an application of the RF cavity is to improve the performance of the 8 GeV Fermilab (Fermi National Accelerator Laboratory, Batavia, Ill.) Booster synchrotron. The rapid tunability of the RF cavity can be exploited to improve synchrotron performance, and the compactness of the cavity permits it to be located in tight spaces. For example, a single second-harmonic cavity for the Fermilab Booster will improve proton capture from a linear accelerator, also referred to as a linac.

Another example of an application of the RF cavity is its potential use in the Main Injector synchrotron at Fermilab. When a new high-intensity superconducting 8 GeV linac eventually replaces the Booster synchrotron, additional RF cavities will be needed in the Main Injector. Again, the rapid tunability and the compactness will provide higher performance in terms of beam intensity.

Figure 1:
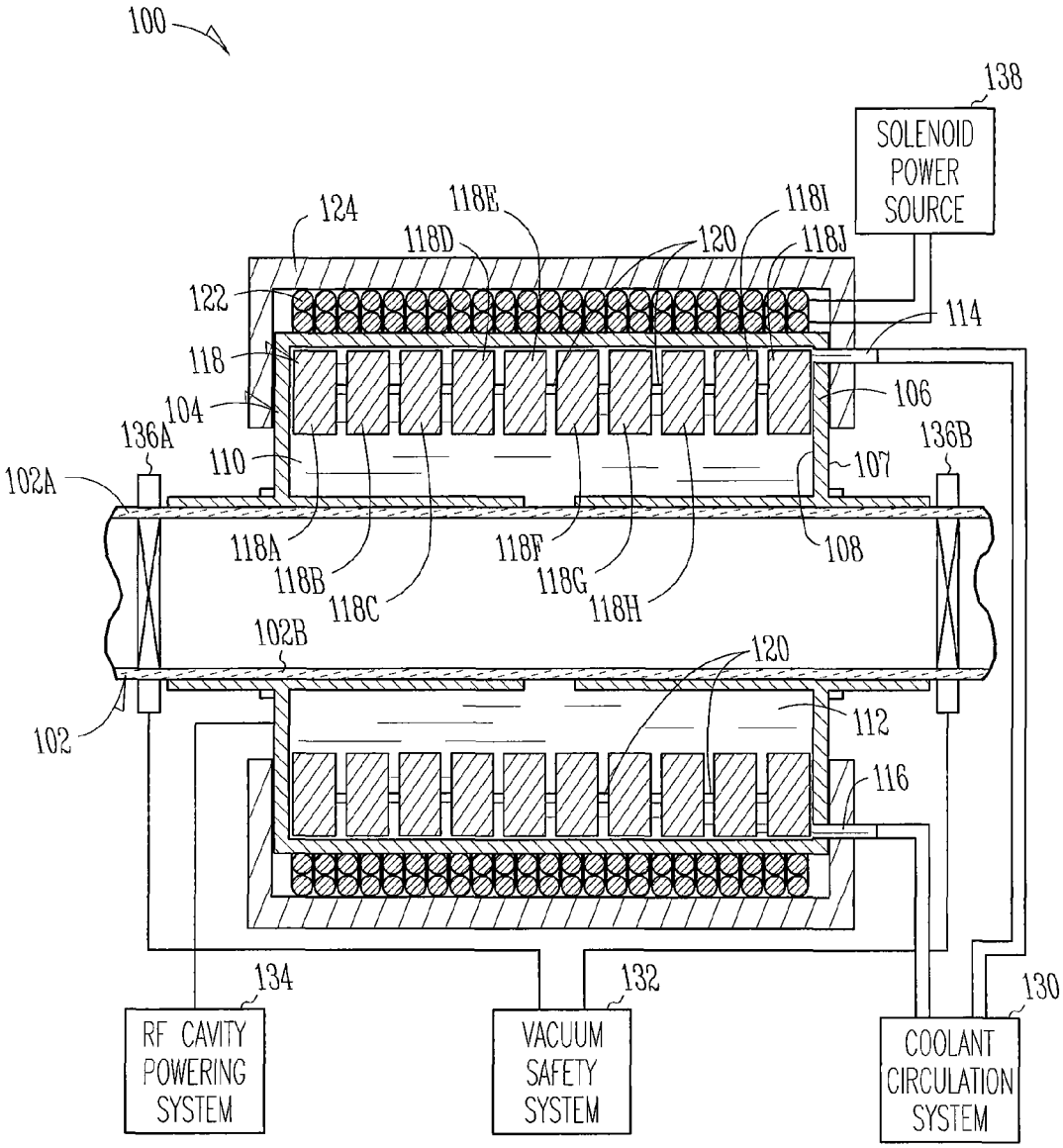
FIG. 1 is an illustration of an embodiment of a system for accelerating particles using an RF cavity.

FIG. 1 is an illustration of an embodiment of an RF cavity system 100 for accelerating particles. RF cavity system 100 is part of a particle accelerator and includes a vacuum beam pipe 102B, an RF cavity 104 surrounding vacuum beam pipe 102B, and various devices and systems supporting the operation of RF cavity 104. Vacuum beam pipe 102B is a portion of a vacuum beam pipe 102, which is part of a vacuum system of the particle accelerator and allows passage of a particle beam that is being accelerated. The portions of vacuum beam pipe 102 outside RF cavity system 100 are referred to as a vacuum beam pipe 102A. In various embodiments, vacuum beam pipe 102B includes a ceramic beam pipe.

RF cavity 104 is a type of pillbox cavity. In the illustrated embodiment, RF cavity 104 includes a wall 106 forming a chamber 110. Wall 106 includes an exterior surface 107 and an interior surface 108. Interior surface 108 faces chamber 110. In various embodiments, wall 106 is made of a non-magnetic metallic material, such as copper or aluminum. Chamber 110 is configured to contain a liquid dielectric 112. A liquid dielectric is also referred to as a dielectric liquid or a dielectric fluid. A liquid inlet 114 on wall 106 allows liquid dielectric 112 to flow into chamber 110. A liquid outlet 116 on wall 106 allows liquid dielectric 112 to flow out of chamber 110.

A ferrite core 118 is placed in chamber 110 and surrounds a portion of vacuum beam pipe 102B. During operation of the particle accelerator, ferrite core 118 occupies substantially the region of high magnetic field, and space between ferrite core 118 and vacuum beam pipe 102B, which is filled by liquid dielectric 112, occupies substantially the region of high electric field. The dielectric constant of liquid dielectric 112 determines the frequency range of RF cavity 104. In various embodiments, the frequency range is to be chosen according to the requirements of each particular application. Liquid dielectric 112 also provides for cooling of ferrite core 118 during the operation of the particle accelerator. Liquid inlet 114 and liquid outlet 116 on wall 106 allow liquid dielectric 112 to be circulated through chamber 110 to remove heat from ferrite core 118. A coolant circulation system 130 coupled to RF cavity 104 pumps liquid dielectric 112 into liquid inlet 114 and out of liquid outlet 116. In the illustrated embodiment, ferrite core 118 includes a plurality of ring-shaped ferrite cores 118A-J. Spacers 120 are used to keep open cooling channels between ring-shaped ferrite cores 118 A-J to ensure effective cooling of ferrite core 118 using liquid dielectric 112 circulating around and between the ring-shaped ferrite cores. A vacuum safety system 132 coupled to RF cavity 104 isolates vacuum beam pipe 102B using valves 136A-B in case of a leak of liquid dielectric 112 into vacuum beam pipe 102B. As illustrated in FIG. 1, valves 136A-B separates vacuum beam pipe 102B from vacuum beam pipe 102A. In other words, vacuum beam pipe 102B refers to the portion of vacuum beam pipe 102 between valves 136A-B, and vacuum beam pipe 102A refers to the remaining portions of vacuum beam pipe 102. When being closed, valves 136A-B retain the leaked liquid dielectric 112 within portion 102B, thereby preventing liquid dielectric 112 from leaking into vacuum beam pipe 102A. Coolant circulating system 130 and vacuum safety system 132 are further discussed below with reference to FIGS. 2 and 8, respectively.

A solenoidal biasing coil 122 surrounds RF cavity 104 over exterior surface 107 of wall 106. Solenoidal biasing coil 122 produces a biasing magnetic field that is orthogonal to the RF magnetic field in RF cavity 104. When compared to other possible field directions, the orthogonal biasing provides for faster frequency tuning with less RF heating loss. Solenoid power source 138 delivers electric current though solenoidal biasing coil 122 to generate the biasing magnetic field. An RF powering system 134 coupled to RF cavity 104 provides for the RF magnetic field in RF cavity 104. RF powering system 134 is further discussed below with reference to FIG. 7.

An iron yoke 124 surrounds solenoidal biasing coil 122 and substantially encloses RF cavity 104. Iron yoke 124 shunts the biasing magnetic field and reduces its effect on the particle beam in vacuum beam pipes 102A-B. In the illustrated embodiment, vacuum beam pipe 102B, chamber 110, ferrite core 118, solenoidal biasing coil 122, and iron yoke 124 are approximately concentric. In one embodiment, one or more solid-state or permanent magnets are incorporated onto, or included in, one or more portions of iron yoke 124 to strengthen the biasing magnetic field. This may lower the power requirement for operating RF cavity system 100 by reducing the current applied to solenoidal biasing coil 122. In a specific embodiment, ring-shaped permanent magnets placed co-axially with ferrite core 118 replace the portions of iron yoke 124 at the end of ferrite core 118 (outside wall 106).

Ferrite core 118 and liquid dielectric 112 allow for tuning of the resonant frequency of RF cavity 104. Changing the magnetic field imposed on ferrite core 118 allows for rapid change of the resonant frequency, such as within a small fraction of a second. In one embodiment, the frequency tuning range of RF cavity 104 is changed by suspending the operation of RF cavity 104 for replacing the currently used liquid dielectric 112 with a liquid dielectric of a different type. In various embodiments, the tunable range of the resonant frequency of RF cavity 104 is determined by the range of magnetic field imposed on ferrite core 118 and types of liquid dielectric available for use as liquid dielectric 112.

Ferrite core 118 is made of a ferrite material. As used in this document, a "ferrite material" includes a material having a permeability ($\mu$) being a function of a magnetic field imposed on that material. This permeability is relatively constant when the intensity of the magnetic field is above a characteristic field, $B_{sat}$. Lower characteristic field requirements allow for faster tuning times for an RF cavity with variable resonant frequency. Another desirable characteristic of the ferrite material is low microwave loss. Lower microwave loss means less heat needs to be removed from the RF cavity for its proper operation.

Ferrite materials that have been tested in a model for RF cavity 104 (discussed below) include (1) a Ni—Zn ferrite having low microwave loss but high magnetic field intensity requirement, and (2) a yttrium iron garnet (YIG) having microwave loss but low magnetic field intensity requirement. Examples of potentially suitable ferrite materials are listed in Table 1.

TABLE 1

| Material | μ | $B_{sat}$ |
|---|---|---|
| Ni—Zn Toshiba M4C21A (1) | 25 | .4-.7 T |
| YIG (2) | 20 | .05-.1 T |
| Ni—Zn Ferroxcube 4E2 | 35 | .35 T |
| Transtech garnet G-250 | 34 | .25 T |
| Transtech garnet G-4260 | 28 | .55 T |

Liquid dielectric 112 has a dielectric constant and a thermal conductivity. A liquid dielectric with a relatively high dielectric constant allows for a relatively small size of the RF cavity. A liquid dielectric with a relatively high thermal conductivity allows for a relatively more efficient removal of the heat generated in the ferrite core.

Liquid dielectric tested in the model for RF cavity 104 includes silicone oil. Examples of potentially suitable liquid dielectrics are listed in Table 2.

TABLE 2

| Material | Dielectric Constant | Thermal Conductivity W/m-K |
|---|---|---|
| Dow Corning 561 Silicone Oil | 2.71 | .151 |
| Midel 7131 | 3.2 | .144 |
| Mineral Oil | 2.2 | .126 |
| Castor Oil | 4.7 | .180 |

Figure 2:
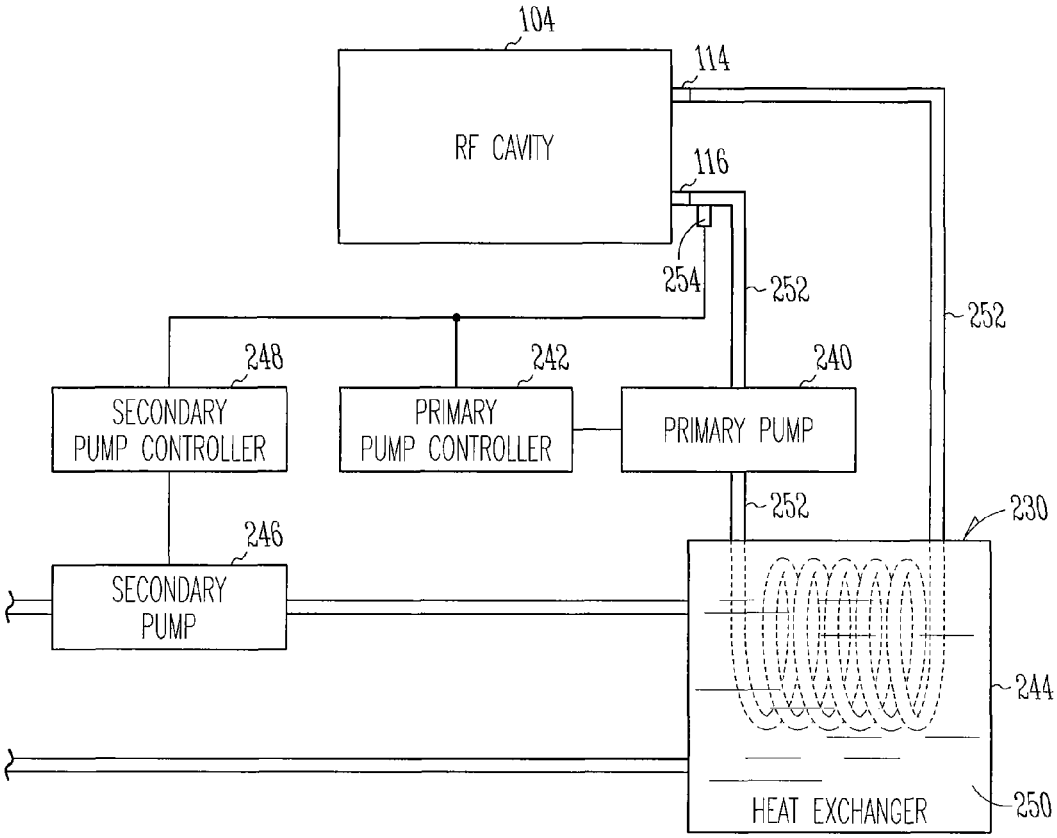
FIG. 2 is a block diagram illustrating an embodiment of a coolant circulation system for the RF cavity.

FIG. 2 is a block diagram illustrating an embodiment of a coolant circulation system 230 coupled to RF cavity 104 via liquid inlet 114 and liquid outlet 116.

Properties of the ferrite material vary with temperature. Therefore, liquid dielectric 112 is used to maintain suitable operating properties of ferrite core 118 by controlling its temperature.

Coolant circulation system 230 is an embodiment of coolant circulation system 130 and includes a primary pump 240, a primary pump controller 242, a heat exchanger 244, a secondary pump 246, a secondary pump controller 248, coolant pipes 252, and a temperature sensor 254. Primary pump 240 pumps liquid dielectric 112 through chamber 110 of RF cavity 104. Primary pump controller 242 controls the pumping speed of primary pump 240. Heat exchanger 244 cools liquid dielectric 112 using a secondary coolant 250. In one embodiment, secondary coolant 250 is water.

Secondary pump 246 pumps secondary coolant 250 through heat exchanger 244. Secondary pump controller 248 controls the pumping speed of secondary pump 246. Coolant pipes 252 connect between RF cavity 104, primary pump 240, and heat exchanger 244 and allow for circulation of liquid dielectric 112 through RF cavity 104, primary pump 240, and heat exchanger 244. In the illustrated embodiment, primary pump 240 pumps liquid dielectric 112 out of RF cavity 104 through liquid outlet 116 and into heat exchanger 244, such that liquid dielectric 112 circulates through RF cavity 104 and heat exchanger 244.

In various embodiments, primary pump controller 242 controls a primary circulation speed at which liquid dielectric 112 circulates through RF cavity 104 and heat exchanger 244, and secondary pump controller 248 controls a secondary circulation speed at which the secondary coolant circulates through heat exchanger 244. Temperature sensor 254 senses a temperature of liquid dielectric 112. In one embodiment, temperature sensor 254 is located in or near RF cavity 104 such that the sensed temperature approximates the temperature of liquid dielectric 112 in chamber 110 of RF cavity 104. In one embodiment, temperature sensor 254 represents a plurality of temperature sensors in RF cavity system 100. In one embodiment, one or both of primary pump controller 242 and the secondary pump controller 248 are used to stabilize the temperature of liquid dielectric 112 in chamber 110 of RF cavity 104 by adjusting one or both of the primary circulation speed and the secondary circulation speed using the temperature sensed by temperature sensor 254. A substantially stable temperature of liquid dielectric 112 ensures that the properties of ferrite core 118 are substantially stable.

A design analysis for RF cavity 104 was performed using computer modeling with Poisson SuperFish provided by Los Alamos Accelerator Code Group (LAACG, Los Alamos National Laboratory, New Mexico, U.S.A.) and ANSYS Multiphysics software (ANSYS, Inc., Canonsburg, Pa., U.S.A.). The analysis was performed using parameters approximately appropriate for the Fermilab Booster. The RF cavity model represents a simple pillbox cavity with a reentrant beam pipe where the accelerating gap is sealed with a ceramic pipe. The fluid inside the RF cavity has a dielectric constant of 4.5 and is used for adjusting the frequency range of the RF cavity and to cool the ferrite core. The biasing coil is a simple water-cooled solenoid. An iron yoke is used to return the biasing field flux. The biasing field is parallel to the axis of the particle beam and orthogonally biases the ferrite core. The RF cavity has a radius of about 30 cm and a length of about 50 cm long.

Table 3 shows the SuperFish calculations of cavity parameters for cases of unbiased ferrite core and biased ferrite core. The calculated parameters are associated with the mesh geometry only, using standard room-temperature copper. The ceramic permittivity is not included in the SuperFish analysis but is included in the ANSYS analysis. This is an ideal calculation without loss factors, so the shunt impedance needs to be corrected when losses are considered in practice.

TABLE 3

| Parameter | Unit | Unbiased | Biased |
|---|---|---|---|
| EZEROT | MV/m | 2.00000 | 2.00000 |
| Frequency | MHz | 38.1892 | 53.5265 |
| rest mass | MeV | 938.27 | 938.27 |
| Beta | | 0.8500000 | 0.8500000 |
| Kinetic E | MeV | 842.865 | 842.865 |
| Norm. factor | E0 = 2.0 MV/m | 14920.021 | 20226.85 |
| Transit-time factor | | 0.9980552 | 0.996171 |
| Stored energy | Joules | 6.150 | 5.788 |
| Surface R | mOhm | 1.61225 | 1.90873 |
| conductor R | μOhm-cm | 1.72410 | 1.72410 |
| Operating T | C | 20.0000 | 20.0000 |
| Shunt Z | MOhm/m | 560.341 | 260.254 |
| Z * T * T | MOhm/m | 558.164 | 258.264 |
| r/Q | Ohm | 212.494 | 161.088 |
| Average B on the outer wall | 2.39587 W/cm^2 | 3707.82 | 5010.41 |
| Maximum H | 2.37226 W/cm^2 | 3700.29 | 4985.67 |
| Maximum E | 0.427349 Kilp. | 3.90856 | 3.8904 |
| Bmax/Emax | mT/(MV/m) | 1.1897 | 1.6104 |
| Emax/E0 | | 1.9505 | 1.9378 |

In the design and fabrication of an RF cavity that can be operated at full power, it is important that the resonant frequency of the completed RF cavity is predictable with high confidence. Therefore, a physical model for RF cavity 104, with solenoidal biasing coil 122 and iron yoke 124, has been constructed and tested to verify mathematical predictions for frequency and quality factor. An aluminum body, which was designed to be easily reconfigured to hold different ring-shaped ferrite cores and/or different liquid dielectrics, was built around a ceramic beam pipe, with rubber O-rings such that the gap between the irises is adjustable. The solenoidal biasing coil winding is water cooled and can provide a magnetic field up to 0.15 T.

Figure 3:
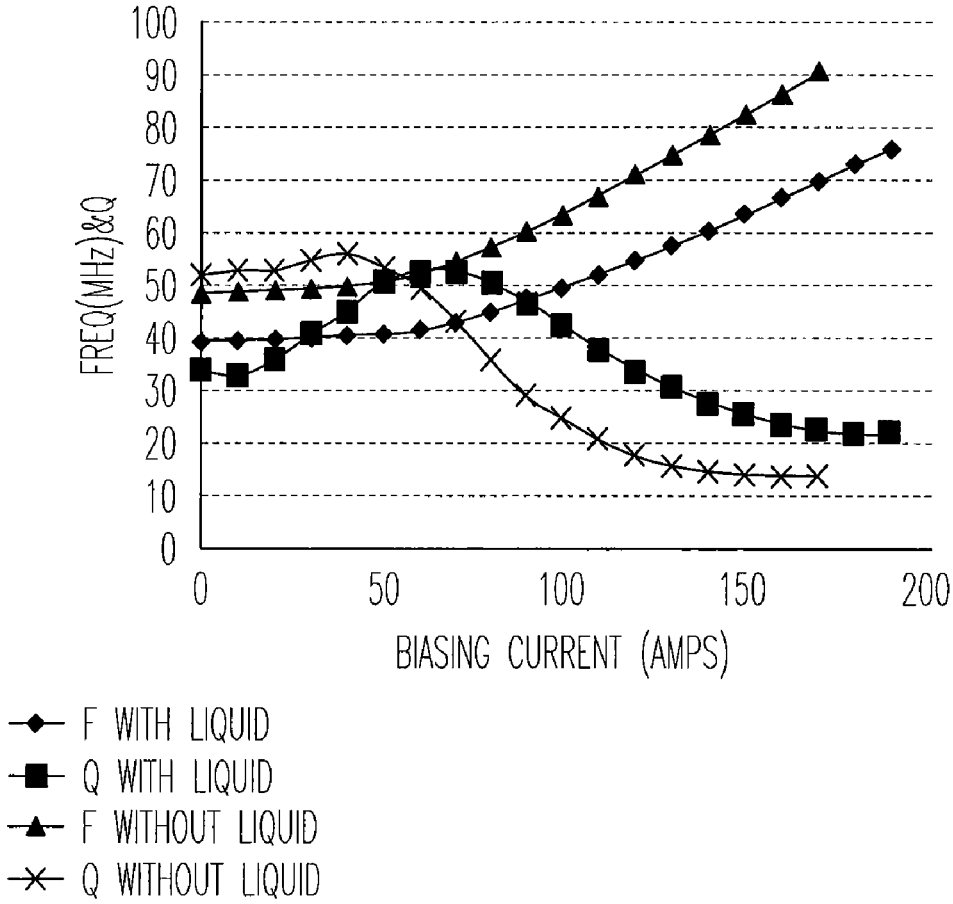
FIG. 3 is a graph presenting parameters measured with the physical model of the RF cavity.

FIG. 3 is a graph presenting frequency and quality factor measurements performed with the physical model. The graph is generated using only data from experimental measurements, without using data from calculations and simulations. The effectiveness of using the biasing current to control and change the ferrite permeability and, consequently, to change the resonant frequency of the RF cavity is investigated. The curves shown in FIG. 3 include (i) resonant frequency of the RF cavity with the liquid dielectric (F WITH LIQ), (ii) quality factor of the RF cavity with the liquid dielectric (Q WITH LIQ), (iii) resonant frequency of the RF cavity without the liquid dielectric (F WITHOUT LIQ), (iv) quality factor of the RF cavity without the liquid dielectric (Q WITHOUT LIQ), each as a function of the biasing current. These curves indicate that the quality factor of the RF cavity is a non-linear function of the biasing current. Also, it appears that the power losses in the RF cavity take place mainly in the ferrite core, and not in the liquid dielectric, because the two quality factor curves are similar in shape and displaced horizontally from one another. Presence of the liquid dielectric changes the frequency tuning range of the RF cavity. The ferrite permeability, as determined by the biasing current, controls the frequency of the RF cavity within the tuning range.

Results of measurements with the physical model show excellent frequency agreement with the numerical simulations carried out with SuperFish and ANSYS based on the measured parameters of the ferrite cores (Ni—Zn ferrite and YIG). The measurements with a liquid dielectric (the Dow Corning 561 Silicone Oil) are also in good agreement with the simulations. These results demonstrate that the properties of the ferrite core and liquid dielectric were accurately measured and that the operation of the models for the RF cavity is well understood. Therefore, operating parameters of the RF cavity is accurately predictable by numerical simulations.

Figure 4:
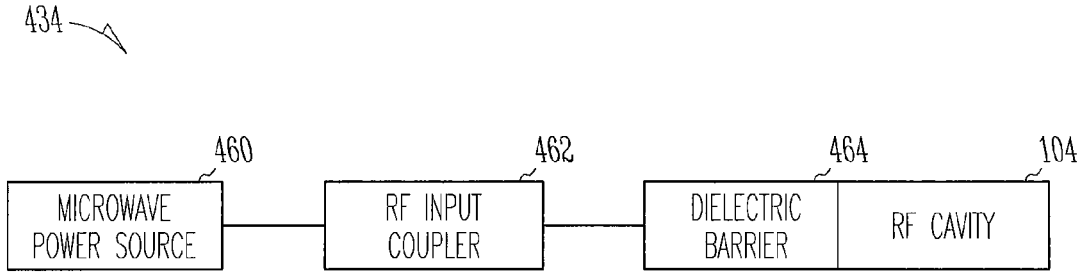
FIG. 4 is a block diagram illustrating an embodiment of a powering system for the RF cavity.

FIG. 4 is a block diagram illustrating an embodiment of a powering system 434 for RF cavity 104. Powering system 434 is an embodiment of RF cavity powering system 134 and includes a microwave power source 460, an RF input coupler 462, and a dielectric barrier 464 that is in contact with RF cavity 104.

RF cavity 104 is powered by electromagnetic energy generated from microwave power source 460 and transmitted via RF input coupler 462 and dielectric barrier 464. RF input coupler 462 is configured to match the broad frequency bandwidth of RF cavity 104 for approximately maximum power transmission efficiency, with an approximately minimum amount of power reflected back to microwave power source 460. Because RF cavity 104 is filled with liquid dielectric 112, the electromagnetic energy travels through dielectric barrier 464, which is coupled between RF input coupler 462 and RF cavity 104. Dielectric barrier 464 is an air-to-cavity dielectric barrier, or window, that is configured to transmit the electromagnetic energy into RF cavity 104. In one embodiment, RF input coupler 462 is an coaxial cable or a waveguide, and dielectric barrier 464 is a rugged ceramic to metal brazed assembly configured to minimize any thermally induced stress that occurs therein.

Figure 5:
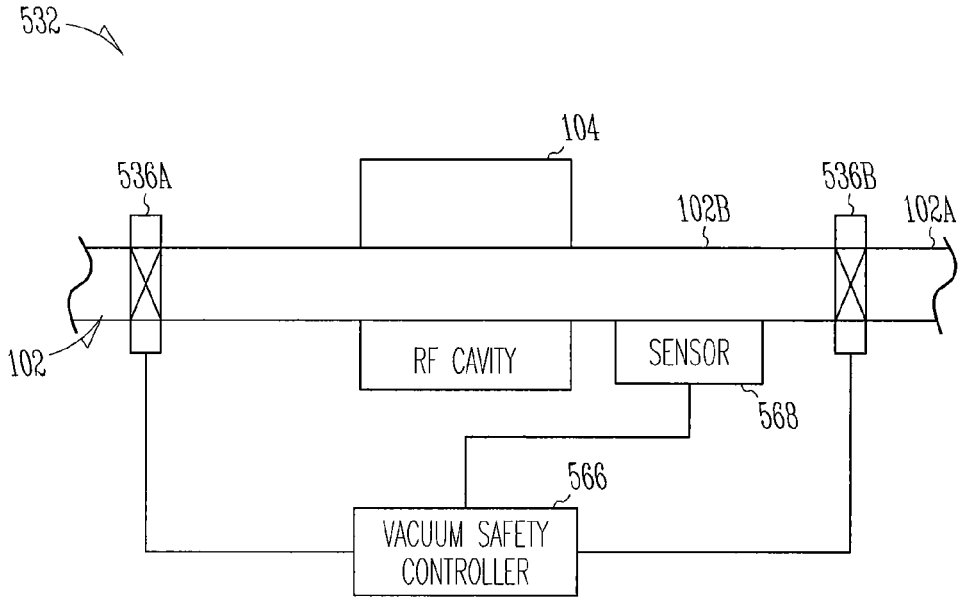
FIG. 5 is a block diagram illustrating an embodiment of a vacuum safety system.

FIG. 5 is a block diagram illustrating an embodiment of a vacuum safety system 532. Vacuum safety system 532 is an embodiment of vacuum safety system 132 and includes fast-acting vacuum valves 536A-B, a sensor 568, and a vacuum safety controller 566.

RF cavity 104, which contains liquid dielectric 112, is separated from the vacuum system of the particle accelerator by the wall of vacuum beam pipe 102B. A leak of liquid dielectric 112 into the vacuum system will potentially prevent the particle beam from circulating and damage the components of the particle accelerator. Therefore, vacuum safety system 532 is provided to prevent potentially serious damages in case liquid dielectric 112 leaks into vacuum beam pipe 102A from RF cavity 104.

Sensor 568 represents one or more sensors each sensing a signal indicative of a leak of liquid dielectric 112 into vacuum beam pipe 102B. In one embodiment, sensor 568 includes one or more pressure sensors each detect a pressure signal indicative of the leak. Fast-acting vacuum valves 536A-B seal off a portion of vacuum beam pipe 102 near RF cavity 104 when being closed. Vacuum safety controller 566 detects the leak using the one or more signals sensed by sensor 568. In response to a detection of the leak, vacuum safety controller 566 closes the fast-acting vacuum valves 536A-B, thereby isolating the portion of vacuum beam pipe 102B from vacuum beam pipe 102A and the rest of the vacuum system of the particle accelerator.

Figure 6:
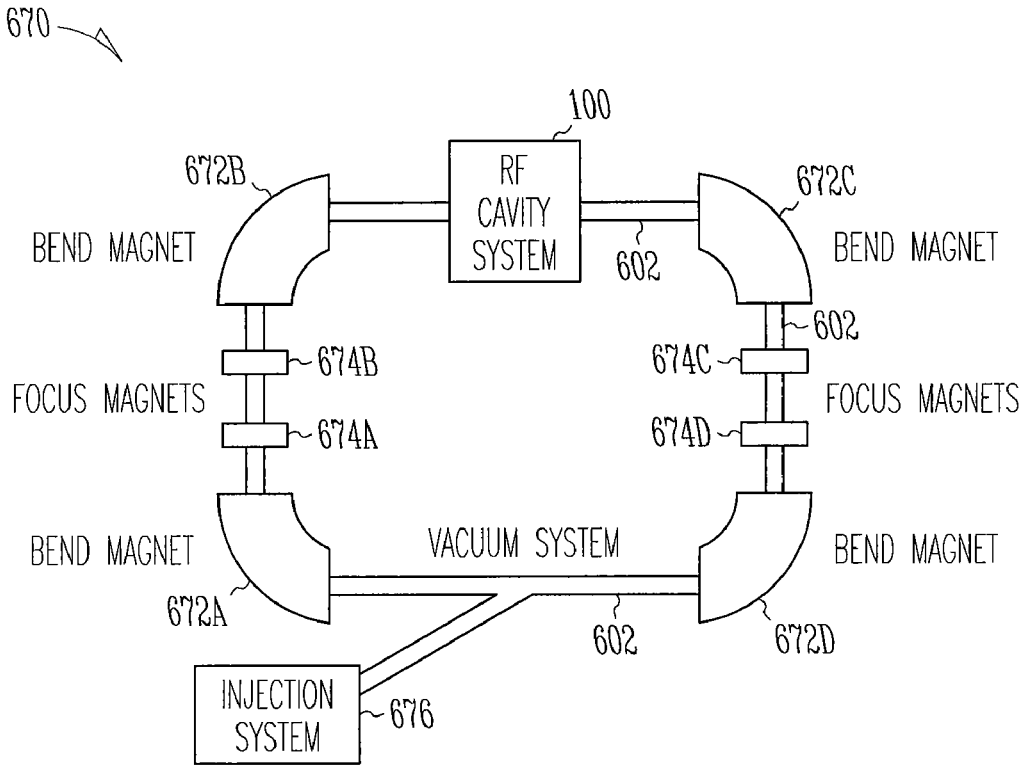
FIG. 6 is a block diagram illustrating an embodiment of a circular particle accelerator including the RF cavity.

FIG. 6 is a block diagram illustrating an embodiment of a circular particle accelerator 670, which includes RF cavity system 100. In the illustrated embodiment, circular particle accelerator 670 includes RF cavity system 100, bend magnets 672A-D, focus magnets 674A-D, and an injection system 676, connected together through an approximately circular vacuum system 602. Vacuum system 602 includes vacuum chambers and pipes constructed of materials such as metal or ceramic.

Circular particle accelerator 670 accelerates particles, such as electrons, protons, and heavy ions, to high energy levels. The particles are collected in a series of particle bunches. Bend magnets 672A-D include electromagnets configured to bend the particle beam around in a trajectory that is approximately circular. Focus magnets 674A-D include electromagnets configured to focus the particle beam to a small transverse size. Injection system 676 injects a low-energy particle beam into vacuum system 602. In one embodiment, injection system 676 includes a linear accelerator, also referred to as linac. RF cavity system 100 accelerates the particle beam by providing an electric field at the time that the particle bunches pass through RF cavity 104.

In one embodiment, bend magnets 672A-D and/or focus magnets 674A-D include one or more electromagnets each formed by two skewed solenoid coils that are energized to produce a dipole field, while the fields produced by the two solenoid coils cancel each other on the longitudinal direction (along the axes of the solenoid coils). An example of such an electromagnet is discussed in D. I. Meyer and R. Flasck, "A New Configuration for a Dipole Magnet for Use in High Energy Physics Applications," *Nuclear Instruments and Methods,* 80 (1970): 339-341.

Figure 7:
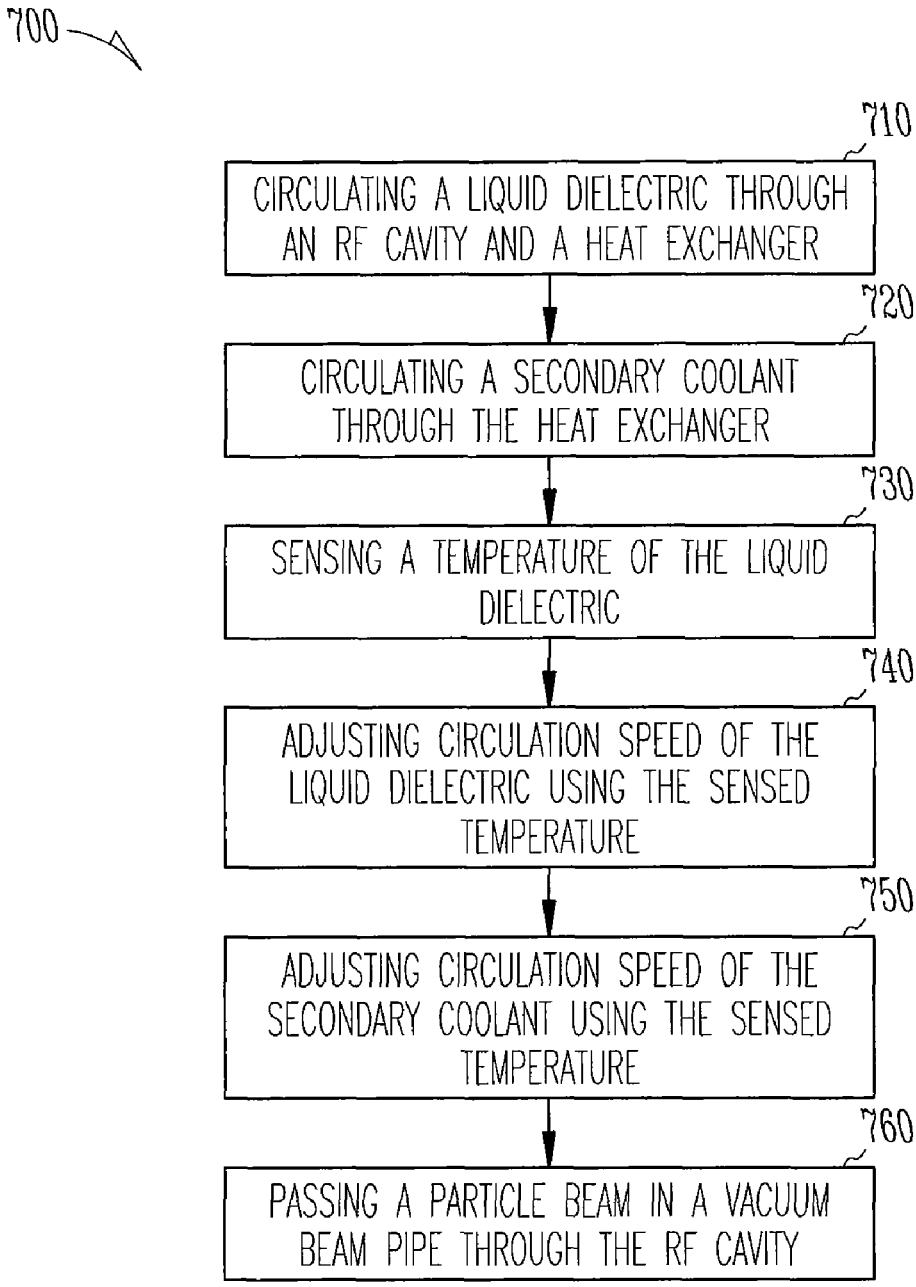
FIG. 7 is a flow chart illustrating an embodiment of a method for accelerating particles using an RF cavity.

FIG. 7 is a flow chart illustrating an embodiment of a method 700 for operating an RF cavity for accelerating particles in a particle accelerator. In one embodiment, method 700 is performed by RF cavity system 100, including its various embodiments as discussed in this document.

At 710, a liquid dielectric is circulated through the RF cavity and a heat exchanger. The RF cavity surrounds a portion of a vacuum beam pipe and includes a ferrite core that is in direct contact with the circulating liquid dielectric. The liquid dielectric cools the ferrite core during operation. An example of the liquid dielectric is silicone oil. The dielectric constant of the liquid dielectric determines the resonant frequency of the RE cavity. In one embodiment, the frequency range of the RF cavity is adjusted by adjusting the dielectric constant of the liquid dielectric. For example, the frequency range of the RF cavity is substantially changed by replacing the liquid dielectric with another liquid dielectric having substantially different dielectric constant. In one embodiment, microwave electromagnetic power is transmitted to the RF cavity from a power source through a dielectric barrier providing for air-to-cavity power transmission. In one embodiment, a pressure signal indicative of a leak of the liquid dielectric into the beam pipe is sensed to provide for detection of the leak. In response to a detection of the leak, valves are closed to confine the leaked liquid dielectric to a portion of the beam pipe near the RF cavity. At 720, a secondary coolant is circulated through the heat exchanger to cool the liquid dielectric. An example of the secondary coolant is water.

At 730, a temperature of the liquid dielectric is sensed. In one embodiment, the temperature is sensed in or near the RF cavity such that it indicates the temperature of the liquid dielectric within the RF cavity. At 740, the speed at which the liquid dielectric is circulated through the RF cavity and the heat exchanger is adjusted using the sensed temperature. At 750, the speed at which the secondary coolant is circulated through the heat exchanger is adjusted using the sensed temperature. In one embodiment, the speed adjustments at 740 and/or 750 allow for stabilization of the temperature of the liquid dielectric in the RF cavity, which in turn stabilizes the properties of the ferrite core during the operation of the particle accelerator.

At 760, the particle beam is passed in the vacuum beam pipe through the RF cavity. In one embodiment, the particle beam is passed when the temperature of the liquid dielectric in the RF cavity is stable. Examples of the particles in the particle beam include ions, protons, muons, and electrons.

It is to be understood that the above detailed description is intended to be illustrative, and not restrictive. For example, structures as shown in various figures, including but not limited to shape and relative size of each system component, arrangement of the components, and number of components (such as the number of the ring-shaped ferrite cores, the number of turns of the solenoidal biasing coil, the number of pipes and magnets, the number of pumps, and the number of RF cavities), is for illustrative purposes only. While specific examples of ferrite materials and liquid dielectric are presented, other suitable materials are also usable as recognizable by those skilled in the art. Other embodiments will be apparent to those of skill in the art upon reading and understanding the above description. The scope of the invention should, therefore, be determined with reference to the appended claims, along with the full scope of equivalents to which such claims are entitled.

What is claimed is:

1. A system for accelerating a particle beam in a particle accelerator, the system comprising:

a vacuum beam pipe adapted to allow passage of the particle beam;

a radio-frequency (RF) cavity surrounding the vacuum beam pipe, the RF cavity including:

a wall forming a chamber;

a liquid dielectric contained in the chamber;

a ferrite core in the chamber, the ferrite core surrounding a portion of the vacuum beam pipe; and a liquid inlet and a liquid outlet on the wall to allow the liquid dielectric to be circulated through the chamber to cool the ferrite core; and a coolant circulation system coupled to the RF cavity through the liquid inlet and the liquid outlet and adapted to circulate the liquid dielectric through the chamber at a first circulation speed and control the first circulation speed using a temperature of the liquid dielectric.

2. The system of claim 1, wherein the liquid dielectric comprises a silicone oil.

3. The system of claim 1, wherein the ferrite core comprises a plurality of ring-shaped ferrite cores.

4. The system of claim 3, wherein the RF cavity comprises spacers placed between the ring-shaped ferrite cores to ensure effective cooling of the ring-shaped ferrite cores using the liquid dielectric.

5. The system of claim 3, comprising a solenoidal biasing coil surrounding the RF cavity, the solenoidal biasing coil adapted to produce a biasing magnetic field orthogonal to an RF magnetic field in the RF cavity.

6. The system of claim 5, comprising an iron yoke surrounding the solenoidal biasing coil and at least partially enclosing the RF cavity.

7. The system of claim 3, wherein the ferrite core comprises a nickel-zinc (Ni—Zn) ferrite.

8. The system of claim 3, wherein the ferrite core comprises a yttrium iron garnet (YIG).

9. The system of claim 1, wherein the coolant circulation system comprises:

a primary pump adapted to pump the liquid dielectric through the chamber of the RF cavity at the first circulation speed;

a heat exchanger adapted to cool the liquid dielectric using a secondary coolant; and coolant pipes allowing for circulation of the liquid dielectric through the RF cavity, the primary pump, and the heat exchanger.

10. The system of claim 9, wherein the coolant circulation system comprises:

a temperature sensor adapted to sense the temperature of the liquid dielectric;

a primary pump controller adapted to control operation of the primary pump;

a secondary pump adapted to pump the secondary coolant through the heat exchanger at a second circulation speed; and a secondary pump controller adapted to control operation of the secondary pump, wherein the primary pump controller and the secondary pump controller are adapted to control one or more of the first circulation speed and the second circulation speed using the sensed temperature.

11. The system of claim 1, comprising a powering system coupled to the RF cavity and adapted to transmit microwave electromagnetic power to the RF cavity; the powering system including:

a microwave power source adapted to generate the microwave electromagnetic power;

an RF input coupler coupled to the microwave power source; and a dielectric barrier coupled between the RF input coupler and the RF cavity, the dielectric barrier adapted to provide for an air-to-liquid barrier that is suitable for electromagnetic power transmission into the chamber of the RF cavity.

12. The system of claim 11, wherein the dielectric barrier comprises a rugged ceramic to metal brazed assembly adapted to reduce thermally induced stress therein.

13. The system of claim 1, comprising a vacuum safety system coupled to the vacuum beam pipe and the RF cavity, the vacuum safety system adapted to isolate a portion of the vacuum beam pipe near the RF cavity from remaining portions of the particle accelerator in response to a leak of the liquid dielectric from the RF cavity into the vacuum beam pipe.

14. The system of claim 13, wherein the vacuum safety system comprises:

one or more pressure sensors adapted to sense one or more pressure signals indicative of the leak;

vacuum valves adapted to isolate a portion of the vacuum beam pipe near the RF cavity from the remaining portions of the particle accelerator; and a vacuum safety controller adapted to detect the liquid leak using the one or more pressure signals and close the vacuum valves in response to a detection of the leak.

15. A method for accelerating a particle beam in a particle accelerator, the method comprising:

passing the particle beam in a vacuum beam pipe through a radio-frequency (RF) cavity including a ferrite core surrounding the vacuum beam pipe;

circulating a liquid dielectric through the RF cavity to cool the ferrite core;

sensing a temperature of the liquid dielectric; and adjusting a first circulation speed at which the liquid dielectric is circulated through the RF cavity using the sensed temperature.

16. The method of claim 15, wherein circulating the liquid dielectric comprises circulating a silicone oil.

17. The method of claim 15, comprising:

circulating the liquid dielectric through a heat exchanger; and cooling the liquid dielectric using a secondary coolant circulating in the heat exchanger.

18. The method of claim 17, comprising adjusting a second circulation speed at which the secondary coolant is circulated through the heat exchanger using the sensed temperature.

19. The method of claim 15, comprising tuning a frequency range of the RF cavity by adjusting a dielectric constant of the liquid dielectric.

20. The method of claim 19, comprising changing the frequency range of the RF cavity substantially by replacing the liquid dielectric with another liquid dielectric having a substantially different dielectric constant.

21. The method of claim 15, comprising transmitting microwave electromagnetic power to the RF cavity from a power source through a dielectric barrier.

22. The method of claim 15, comprising:

sensing one or more pressure signals indicative of a leak of the liquid dielectric into the vacuum beam pipe;

detecting the leak using the one or more sensed pressure signal; and closing vacuum valves in response to a detection of the leak, the vacuum valves confining leaked liquid dielectric to a portion of the vacuum beam pipe near the RF cavity.

23. The method of claim 15, wherein passing the particle beam through the RF cavity comprises passing a beam of ions through the RF cavity.

24. The method of claim 15, wherein passing the particle beam through the RF cavity comprises passing a beam of protons through the RF cavity.

25. The method of claim 15, wherein passing the particle beam through the RF cavity comprises passing a beam of muons through the RF cavity.

26. The method of claim 15, wherein passing the particle beam through the RF cavity comprises passing a beam of electrons through the RF cavity.

* * * * *

UNITED STATES PATENT AND TRADEMARK OFFICE

CERTIFICATE OF CORRECTION

PATENT NO. : 8,159,158 B2
APPLICATION NO. : 12/359810
DATED : April 17, 2012
INVENTOR(S) : Popovic et al.

It is certified that error appears in the above-identified patent and that said Letters Patent is hereby corrected as shown below:

On the Title page:
Item (56) References Cited under "Other Publications", in column 2, line 18,
delete "(1998)," and insert -- (1988), --, therefor.

Signed and Sealed this
Seventh Day of August, 2012

David J. Kappos

David J. Kappos
*Director of the United States Patent and Trademark Office*